US005697675A

United States Patent [19]

DeWitt et al.

[11] Patent Number: 5,697,675

[45] Date of Patent: Dec. 16, 1997

[54] PORTABLE COLLAPSIBLE STOOL

[75] Inventors: Carl F. DeWitt, Westminster; Kory H. Kime; Frederick M. Wise, both of Arvada; Raymond R. Sainz, Denver, all of Colo.

[73] Assignee: Capitol Packaging Corp., Denver, Colo.

[21] Appl. No.: 598,732

[22] Filed: Feb. 8, 1996

[51] Int. Cl.[6] ..... A47C 4/02

[52] U.S. Cl. ..... 297/440.12; 297/188.01

[58] Field of Search ..... 297/440.12, 188.01; 248/174

[56] References Cited

U.S. PATENT DOCUMENTS

| | | | |
|---|---|---|---|
| 1,718,319 | 6/1929 | Towell | 248/174 |
| 2,685,963 | 8/1954 | Loerinc | 248/174 X |
| 2,941,773 | 6/1960 | Rosenbacher | 248/174 |
| 3,097,016 | 7/1963 | Bigler, Jr. | 297/440.12 |
| 3,126,140 | 3/1964 | Lizan et al. | 297/440.12 X |
| 3,128,984 | 4/1964 | Palm | 248/174 X |
| 3,220,362 | 11/1965 | Downes | 297/440.12 X |
| 3,566,808 | 3/1971 | Slate, Jr. | 297/440.12 X |
| 3,727,979 | 4/1973 | Schier et al. | 297/440.12 |
| 4,424,906 | 1/1984 | Richmond | 248/174 X |
| 4,428,555 | 1/1984 | Atkins | 248/174 X |
| 4,556,253 | 12/1985 | Geneve et al. | 297/440.12 |
| 4,648,658 | 3/1987 | Calco | 297/440.12 |
| 4,687,248 | 8/1987 | Ross et al. | 297/188.01 X |
| 5,382,081 | 1/1995 | Henry | 297/440.12 |

FOREIGN PATENT DOCUMENTS

| | | | |
|---|---|---|---|
| 2505636 | 11/1982 | France | 297/440.12 |
| 2205473 | 8/1973 | Germany | 297/440.12 |

OTHER PUBLICATIONS

Three (3) Pictures Showing Sample of Product acquired in Phoenix, Arizona.

*Primary Examiner*—Peter M. Cuomo
*Assistant Examiner*—David E. Allred
*Attorney, Agent, or Firm*—Timothy J. Martin; Michael R. Henson

[57] ABSTRACT

A collapsible stool provides a seat for a user and can be erected for use or folded into a collapsed state. The stool includes first and second side panels that confront one another when collapsed but expand to create a longitudinally extending support post. First and second seat panels are hingedly disposed on the respective top edges of the first and second side panels, and the seat panels terminate in edge margins that interlock to form a seat for the user. The seat is preferably saddle-shaped and has a central peak. The first and second side panels and the first and second seat panels are each preferably constructed of multi-panel sections, and the stool may be an integral piece of corrugated material, such as fiberboard. A holder, such as for a beverage container, is preferably disposed on one of the side panels and is movable between an open position and a closed position alongside the side panel.

29 Claims, 5 Drawing Sheets

PORTABLE COLLAPSIBLE STOOL

FIELD OF THE INVENTION

The present invention broadly relates to stools which are operative to support a person in a seated position. More particularly, the present invention concerns portable stools which may be used as temporary seating, especially for outdoor events.

BACKGROUND OF THE INVENTION

Since primordial humans first huddled around campfires, there has been a constant effort to increase bodily comfort. Not only has this effort included the construction of shelters to protect against the external environment, but also this effort has included the design and construction of articles of furniture upon which a person may repose himself/herself. From early use of rocks and logs to the most modern chairs, lounges and beds, the provision of more comfortable furniture has been the subject of many innovations.

Sometimes, however, the events of human life create situations wherein comfortable furniture is not at hand. For example, a person attending an outdoor activity may sometimes find a lack of convenient seating upon which to rest. Examples of such activities include sporting events, picnics, outdoor markets, to name a few. In such situations, a person finds that he/she must resort once again to sitting on the ground, rocks, logs, curbs, or other objects not particularly suited for sitting. Such arrangements are naturally uncomfortable where the person does not desire to remain standing since such seating is not generally configured for a restful position for the human body either as a result of a non-ergonomic contour or height for the typical human frame.

The use of both portable and temporary seats has been well-known in the past. For example, various folding chairs which may be unfolded for use yet folded for storage. Various folding camping chairs, lounge and lawn chairs have been developed which can be transported by a person to a desired location for use. Other chairs and stools, while not folding, have been developed which are small enough to be relatively portable. These existing types of seats or chairs, however, have respective drawbacks. Many are heavy or awkward to transport long distances by hand. Other such prior art chairs are fairly costly to produce. Where carried, such seats interfere with the ability of the person to carry other objects.

One attempt to provide a light-weight, inexpensive temporary seat is evidenced by a product known as "Box Seats". This product comprises a cardboard seat which has a vertical column of relatively small triangular cross-section which flares outwardly at its upper end to create a triangular seat upon which a person may sit. The flared seat may fold together in an effort to collapse the seat into a more transportable unit. This cardboard seat, however, does not supply support completely across its width since it is open in a central area that corresponds to the cross-sectional dimension of the upright column. Since the cross-section of this column must be kept relatively small to maintain this opening as small as possible, the reduced dimension creates some instability of the seat. An expansion of this dimension of the column, however, in an effort to increase stability correspondingly increases the central non-supported region for the posterior of the person. Moreover, the outer peripheral margin of the triangular seat is fairly weak since it does not receive any vertical support at its periphery.

Accordingly, there is a continuing need for improved portable seating which can readily be transported by a person during a variety of activities. Another need exists for portable seating which is relatively inexpensive in manufacture. There is a further need for such portable seating to be constructed in a manner that will support the human body in a comfortable and stable manner.

SUMMARY OF THE INVENTION

It is an object of the present invention to provide a new and useful stool which can be readily transported by a person for use as a convenient, temporary seat.

Another object of the present invention is to provide a portable stool which is made out of a corrugated material so as to be relatively inexpensive in manufacture.

Still a further object of the present invention is to provide a portable stool which is collapsible into a stored state yet which is expandable into an erected state for use.

Yet a further object of the present invention is to provide a collapsible stool which collapses into a stored state yet, when erect, provides a comfortable, stable support for a person seated thereon.

A further object of the present invention is to provide a portable stool which is constructed so as to allow the stool to be used as a carrying carton.

Yet another object of the present invention is to provide a combination stool and carrying carton into which sheet-like objects may be deposited from the exterior with the carton being suitable for commercial shipment.

It is yet another object of the present invention to provide a portable stool that has a auxiliary support for a beverage container.

According to the present invention, then, a collapsible stool is provided with this stool being adapted to support a user in a seated position above a support surface when in an erected state. This collapsible stool is foldable, though, into a collapsed state for transport and storage.

In its broad form, the collapsible stool has first and second side panels that confront one another when the stool is in the collapsed state yet which may be expanded away from one another when the stool is in the erected state. When expanded away from one another, the first and second side panels create a support post extending in a longitudinal direction about a longitudinal axis. When erected, this support post has a base edge adapted to engage the support surface, a top edge opposite the base edge and a surrounding sidewall formed by the first and second side panels which encloses an interior of the support post. First and second seat panels are hingedly disposed on the first and second side panels, respectively, and these first and second seat panels are movable into an orientation wherein they extend inwardly toward one another from the top edge of the support post when the stool is in the erected state. Thus, the first and second seat panels form a seat upon which a user may sit in the seated position. This seat member is preferably configured in a saddle-shape having elevated forward and rearward corner portions relative to a middle portion thereof.

Preferably, the collapsible stool of the present invention is formed as an integral piece of corrugated material, either plastic or cardboard, with the corrugations extending longitudinally. Moreover, it is preferred that the first and second side panels each be constructed of a plurality of side panel sections with adjacent ones of the side panel sections being hingedly connected to one another about longitudinally extending side hinge lines. The first and second side panels are then respectively secured to one another along longitudinally extending front and rear hinge lines. Likewise, it is preferred that each of the first and second seat panels be constructed of a plurality of seat panel sections with adjacent ones of the seat panel sections being hingedly connected to one another along seat hinge lines. Each of the seat hinge lines, then, are formed as an extension of a respective side hinge line. Where formed of corrugated material, these hinge lines are each formed by weakened scorelines in the corrugated material.

In order to protect the stool from becoming weakened due to water damage, especially along with the base edge of the support post, it is desirable to protect the base edge for contact against the support surface. Several alternatives are provided. For example, first and second bottom flaps may be respectively formed as intregal extensions of the first and second side panels with the first and second bottom flaps being disposed along the lower edge of the support post. These first and second bottom panels are then foldable into a transverse orientation with respect to the longitudinal axis. Where the stool is formed of corrugated material, these flaps help prevent wicking of moisture into the lower base portions of the base member. Alternatively, a protective coating may be disposed on the first and second side panels along lower edge margins thereof which are adjacent the lower edges of the first and second side panels.

Where first and second bottom flaps are provided along the base edge of the support post, they may be sized to extend sufficiently across the base of the support post to interlock with one another thereby to enclose a base end of the support post. This also allows the stool to be used as a carrying carton, where desired. Here, a longitudinal insertion slot may be employed to permit deposit of sheet materials into the interior. Preferably, the support post, when erected, forms a hollow columnar member for strength. It is also desirable that the first and second seat panels be sized and configured so that, when interlocked, they are each inclined upwardly toward one another to form a central peak. The first and second panels may also have handle openings formed therein which register with one another when the in the collapsed state thereby to provide a carrying handle for the stool.

It is also desirable to provide a holder disposed on one of the first and second side panels with this holder being movable between an open position to project outwardly from the stool. This holder is operative to receive and support an object, such as a beverage container. This holder may be movable to a closed position where it is stored alongside the side panel. Where the stool is formed of corrugated material, it is preferred that this holder be formed by a cutout portion of a side panel. A backing panel may be disposed interiorly of the support post to span the cutout region of the side panel to maintain the integrity thereof. Here, also, it is preferred that the holder be formed as a U-shaped flange defined by a pair of spaced apart legs pivotally joined to one another by an outer connecting band. A support arm is pivotally joined to the respective side panel and to the outer connecting band thereby to form a base for the holder and to support the outer connecting band so that the U-shaped flange may surround a container placed therein. The backing panel may be provided with a slot, and the holder may include a tab sized to be inserted into this slot thereby to retain the holder in the stored state.

With this construction, it is also desired that both of the front panel sections have a common width and that both of the rear panel sections have a common width with the width of the front panels being greater than the width of the rear panels. Thus, the seat will have an elongated forward portion and a foreshortened rear portion. When the seat is formed as a saddle, this provides ergonomic support.

These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENTS

The present invention is directed to a portable collapsible stool which is foldable into a collapsed state for transportation and storage yet which may be expanded into an erected state for use. During use, the stool provides a convenient seat for a person in situations where other seating is unavailable. Thus, the present invention has particular usefulness for outdoor activities, such as sporting events, open air markets, picnics, etc. where there is little or no seating. The present invention may also be readily employed, for example, by shoppers when seating in shopping malls in unavailable or occupied. Of course, the portable collapsible stool according to the present invention may be employed in a host of other applications, and its use is therefore not intended to be limited by the examples provided herein.

In its broad form, the portable collapsible stool is constructed of first and second side panels that confront one another when the stool is in the collapsed state yet which are expanded away from one another when the stool is in an erected state. When erected, the first and second side panels create a support post that extends about a longitudinal axis in a longitudinal direction. This support post may be in the form of a hollow column, and it has a base edge adapted to engage a support surface and a surrounding sidewall that surrounds a generally open interior. First and second seat panels are hingedly disposed along a top edge of the first and second side panels with the first and second seat panels being movable into an orientation wherein they extend inwardly toward one another to form a seat upon which the user may sit. In the preferred exemplary embodiment, this seat member is configured in a saddle shape having elevated forward and rearward corner portions relative to a middle portion thereof.

Figure 1:
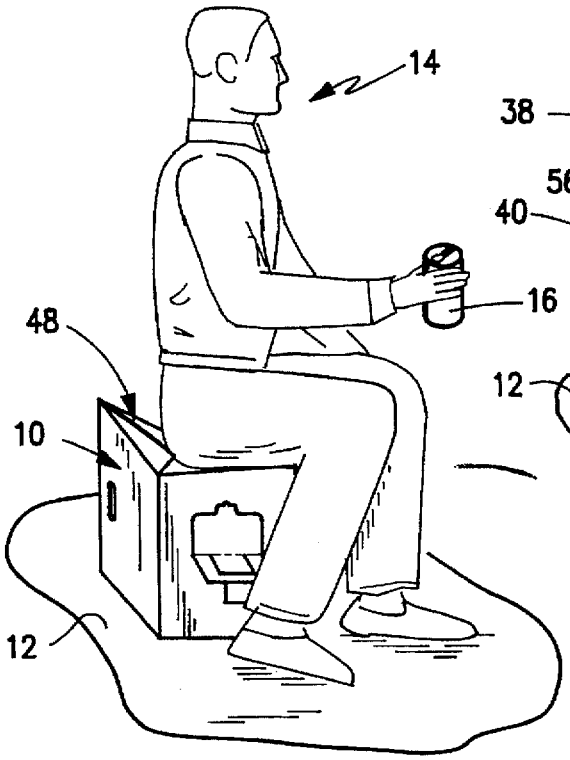
FIG. 1 is a perspective view of the portable collapsible stool according to a first embodiment of the present invention shown in use wherein a person is sitting thereon.
Figure 9:
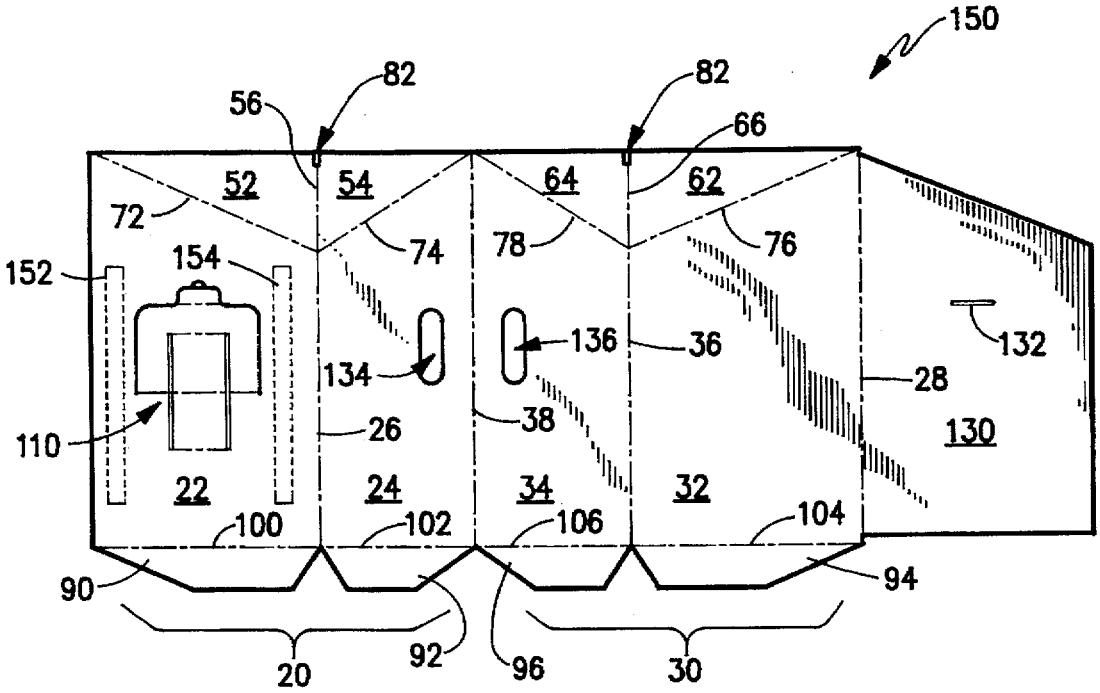
FIG. 9 is a side view in elevation of a piece of corrugated material used to form the portable collapsible stool according to the first exemplary embodiment of the present invention.

A first exemplary embodiment of the present invention, then, is shown in FIGS. 1–8, and an integral piece of corrugated material used to form this embodiment of the present invention is shown in FIG. 9. Turning first to FIG. 1, though, it may be seen that collapsible stool 10 is in an erected state wherein it rests on a support surface 12 and a person 14 is shown seated thereon. Person 14 is shown holding a beverage container or can 16. Person 14 is also shown in a seated position facing a forward direction on a saddle-shaped seat 48.

Figure 6:
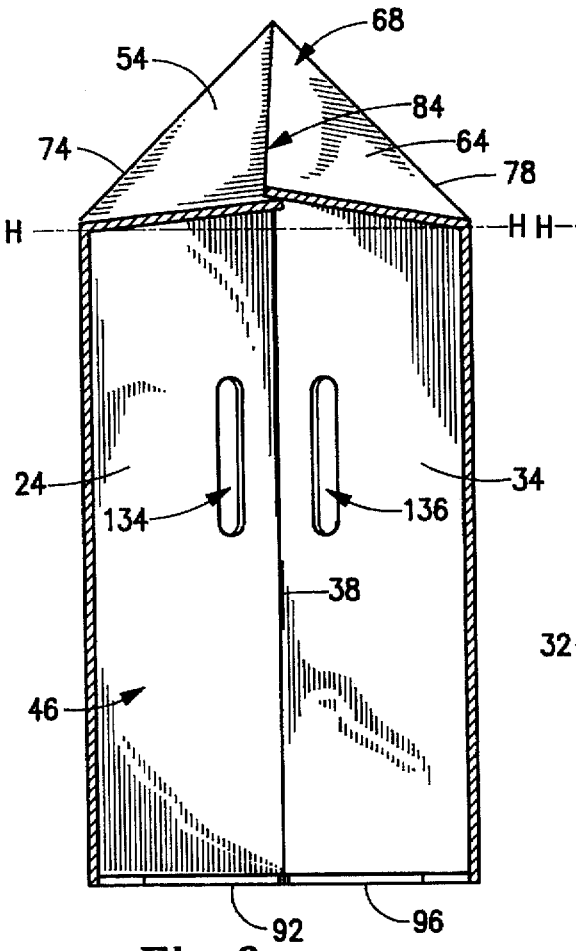
FIG. 6 is a cross-sectional view taken about lines 6—6 of FIG. 3.
Figure 7:
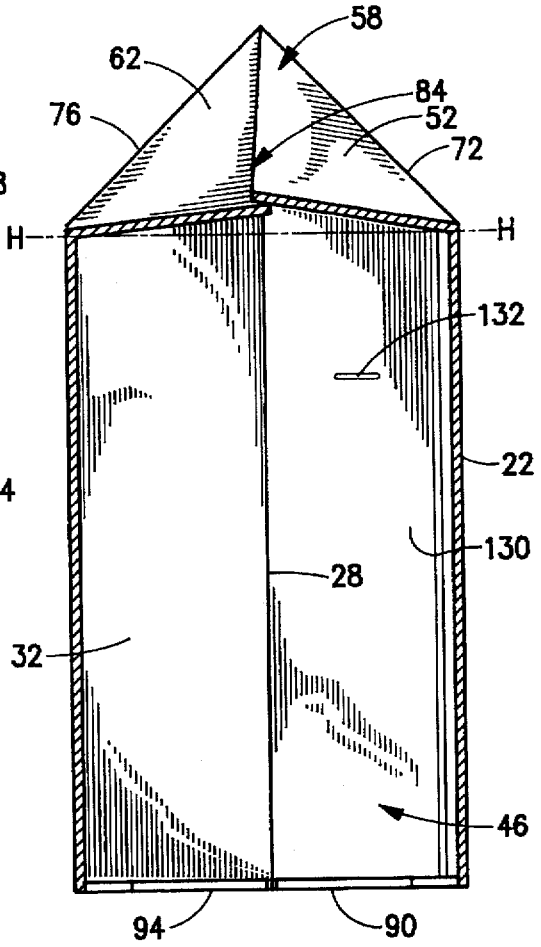
FIG. 7 is a cross-sectional view taken about lines 7—7 of FIG. 3.
Figure 8:
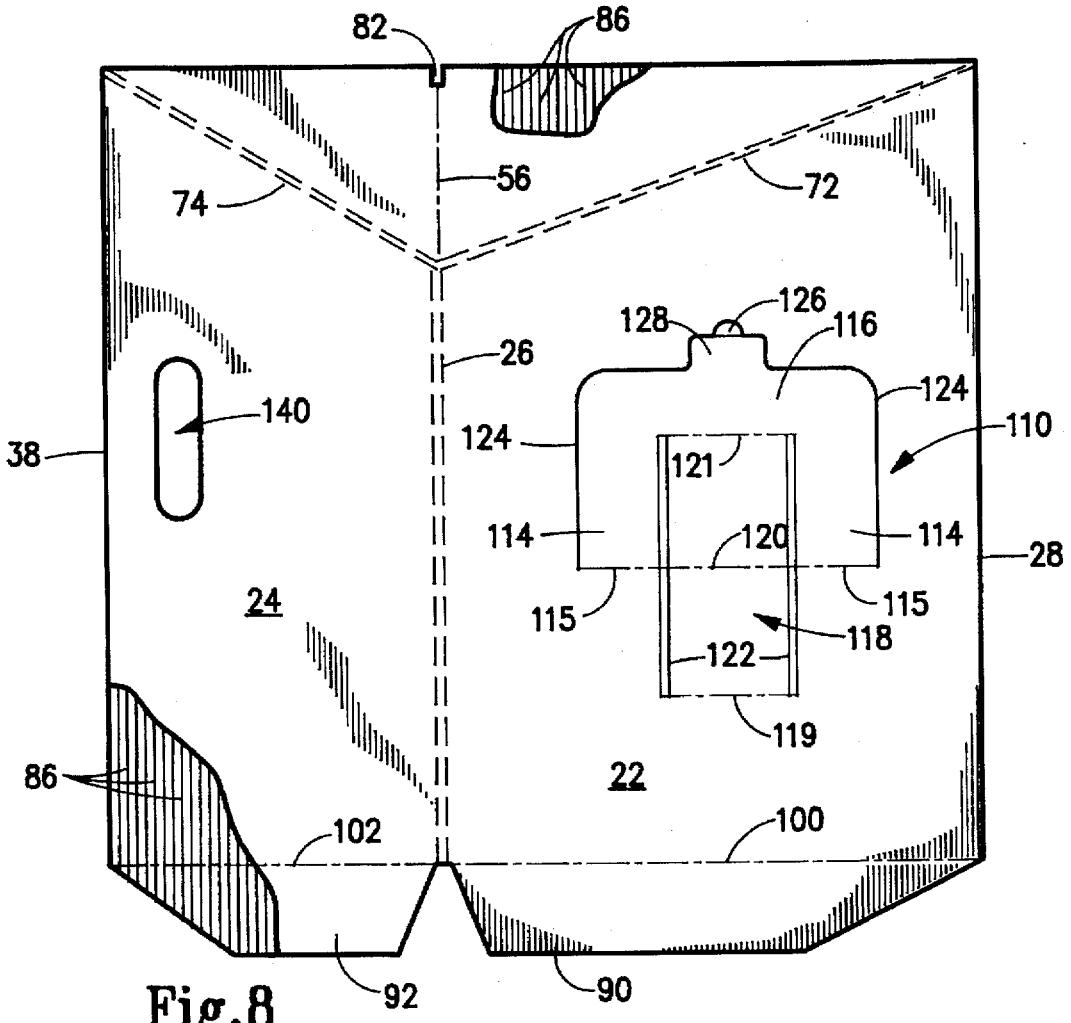
FIG. 8 is a side view in elevation of the first exemplary embodiment of the present invention shown in the collapsed state.

The construction of stool 10 is best shown in reference to FIGS. 2–8. In these figures, it may be seen that stool 10 is formed by a first side panel 20 and a second side panel 30. While it is possible that each of first and second side panels 20 and 30 can be formed of a single section, it is preferred that first side panel 20 be formed by a plurality of first side panel sections such as front first side panel section 22 and rear first side panel section 24 which are hingedly secured to one another about a longitudinally extending first side hinge line 26. Similarly, second side panel 30 is formed of a plurality of second side panel sections such as front second side panel section 32 and rear second side panel section 34. Second front side panel section 32 and second rear side panel section 34 are joined along a longitudinally extending second side hinge line 36. First and second side panels 20 and 30 are hingedly connected to one another along a longitudinally extending front hinge line 28 and along a longitudinally extending rear hinge line 38 so that they may be moved from a collapsed state, such as shown in FIG. 8, wherein first and second side panels 20 and 30 confront, one another to an erected state, such as shown in FIGS. 2–7, wherein first and second side panels 20 and 30 are expanded away from one another. When in the erected state, it may be seen that first and second side panels 20 and 30 create a hollow columnar support post 40 that extends longitudinally along a longitudinal axis "L". When in the erected state, support post 40 has a base edge 42 adapted to engage support surface 12, a top edge 44 opposite base edge 42 and a surrounding sidewall formed by first and second side panels 20 and 30. Accordingly, support post 40, when in the erected state, has a generally open interior 46.

A seat 48 extends transversely of support post 40 when in the erected state. Seat 48 is formed by a first seat panel 50 and a second seat panel 60 which are respectively disposed on first and second side panels 20 and 30. First seat panel 50 is preferably formed of a plurality of first seat panel sections such as front first seat panel section 52 and rear first seat panel section 54 which are hingedly secured to each other along first seat hinge line 56. Similarly, second seat panel 60 is formed by a front second seat panel section 62 and a rear second seat panel section 64 which are hingedly joined to one another along a second seat hinge line 66.

First seat panel 50 is preferably formed as a longitudinal extension of the first side panel 20 such that first seat hinge line 56 is an extension of first side hinge line 26. Accordingly, front first seat panel section 52 is hingedly secured to front first panel section 22 along hinge line 72 while rear first seat panel section 54 is hingedly secured to rearward first panel section 24 along hinge line 74. Hinge lines 72 and 74 accordingly define an upper edge for first side panel 20. Likewise, front second seat panel section 62 is hingedly secured to front second side panel section 32 along hinge line 76, and rear second seat panel section 64 is hingedly secured to rear second side panel section 34 along hinge line 78. Hinge lines 76 and 78 accordingly define an upper edge for second side panel 30. Moreover, hinge lines 72, 74, 76 and 78 form the top edge 44 for support post 40 when in the erected state. Thus, second seat panel 60 is formed as a longitudinal extension of the second side panel with second seat hinge line 66 formed as an extension of second side hinge line 36.

With reference to FIGS. 3 and 5–7, it may be seen that seat 48 is preferably configured in a saddle-shape having an elevated forward corner portion 58 and an elevated rearward corner portion 68 relative to a middle portion 70 thereof. That is, when the first and second seat panels 50 and 60 are moved into an orientation wherein they extend inwardly toward one another from top edge 44 to form seat 48, the forward and rearward portions of seat 48 extend upwardly and are outwardly divergent from one another with respect to a horizontal plane "H" that is generally parallel to the support surface. Moreover, with reference to FIGS. 3 and 5–9, it may be seen that first and second seat panels 50 and 60 are provided with a cooperative inner lock structure 80 in the form of matable notches, such as notch 82, so that first and second seat panels 50 and 60 may be releasably secured together with their interior margins 83 overlapped when forming seat 48. Here, also, it should be appreciated that first and second seat panels 50 and 60 are sized and configured so that, when interlocked, each are inclined upwardly toward one another to form a central peak 84. That is, as is shown in FIGS. 6 and 7, the rear first and second seat panel sections 54, 64, are oriented at a large obtuse angle with respect to one another while front first and second seat panel sections 52 and 62 are likewise oriented at a large obtuse angle with respect to one another. Preferably this angle is approximately 140°–160° so that, at middle portion 70, each of these seat panel sections are oriented at a small acute angle of about 10° to 20° with respect to horizontal plane "H".

As noted above, it is preferred that the collapsible stool 10 according to the present invention be formed as a single, integral piece of corrugated material, such as corrugated fiberboard, plastic corrugated material or the like. However, it should be recognized that other materials, including solid plastics, paper, etc., can be employed without departing from the scope of the invention. When constructed of corrugated material, though, front hinge line 28, rear hinge line 38, first side hinge line 26, second side hinge line 36, first seat hinge line 56 and second seat hinge line 66 are all formed as creased scorelines in the corrugated material so that folding is facilitated along the creased lines. Moreover, with reference to FIG. 8, it may be seen that the corrugations 86 extend longitudinally to give greater columnar vertical support when support post 40 is formed as a hollow column when the stool is in the erect state. Where corrugated fiberboard is employed, the preferred material is 275 pound, B-flute.

Figure 4:
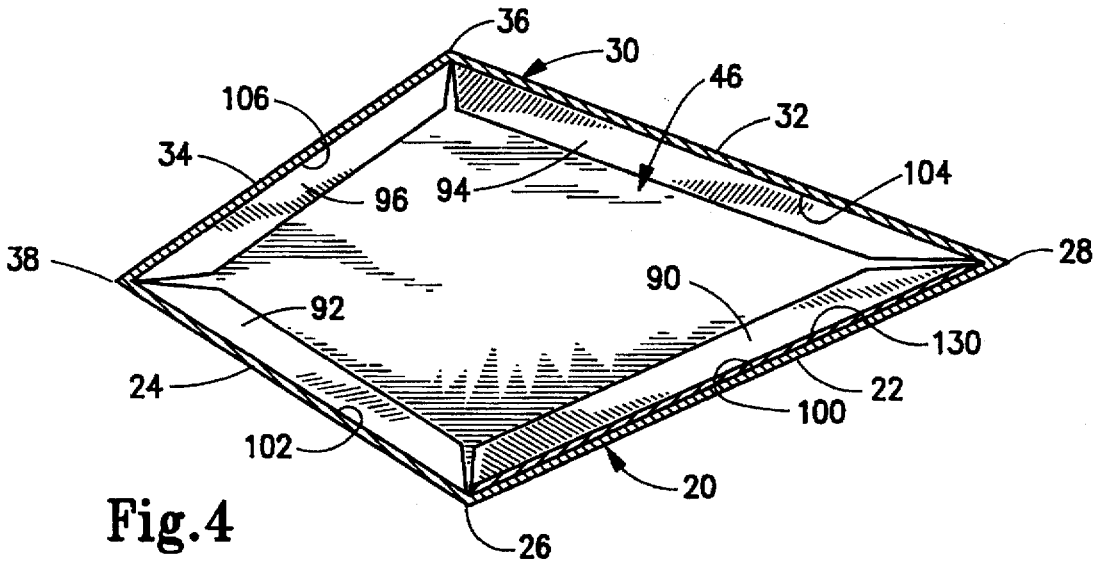
FIG. 4 is a cross-sectional view taken about lines 4—4 of FIG. 3.
Figure 5:
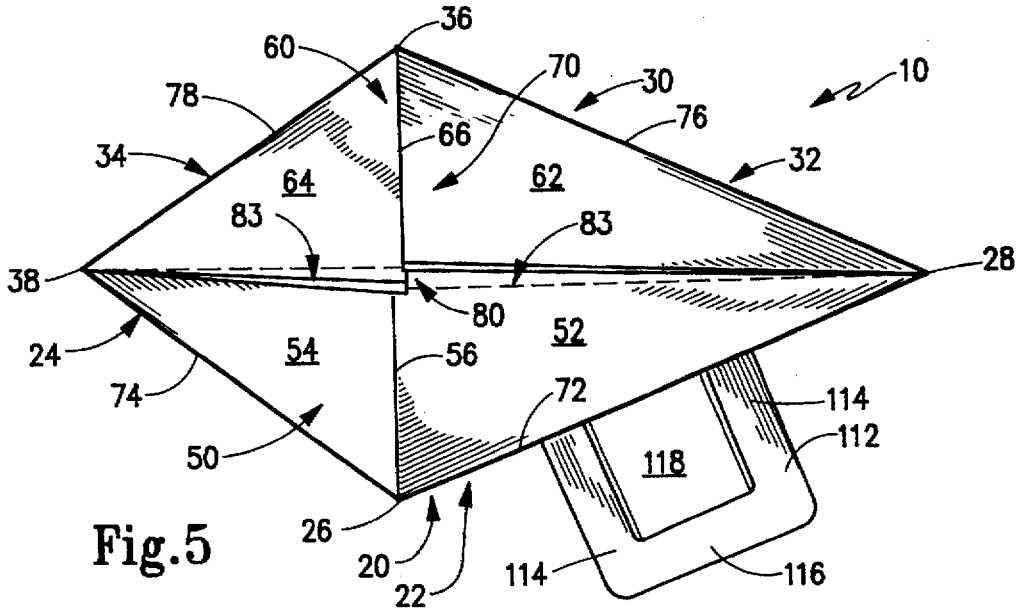
FIG. 5 is a top plan view of the first exemplary embodiment of the present invention.

Since it is possible that stool 10 be employed on a damp support surface, such as the ground, it is desirable to maintain the structural integrity of support post 40. To this end, it is desired to minimize any intrusion of moisture which would weaken the corrugated material. Since the longitudinal orientations of corrugations 86 can increase the wicking action of moisture, the base edge 42 of support post 40 is protected by a plurality of bottom flaps. As is shown in FIG. 4, a first bottom flap for first side panel 20 is actually formed by a front first flap 90 and a rear first flap 92 while a second flap for second side panel 30 is formed by a front second flap 94 and a rear second flap 96. As is shown in this Figure, and in FIGS. 6 and 7, these flaps are respectively formed as integral extensions of their associated side panel sections 22, 24, 32 and 34. As is shown in FIGS. 4, 6 and 7, these flaps 90, 92, 94 and 96 are foldable into a transverse orientation with respect to longitudinal axis "L" preferably towards one another and into the interior 46 of support post 40 when in the erected state. Thus, flaps 90 and 92 are foldable, respectively, about score or hinge lines 100 and 102, and flaps 94 and 96 are foldable, respectively about score or hinge lines 104 and 106. Hinge lines 100 and 102 form a lower edge for first side panel 20, and hinge lines 104 and 106 form a lower edge for second side panel 30. Moreover, these hinge lines 100, 102, 104 and 106 form the base edge 42 for support post 40.

Figure 2:
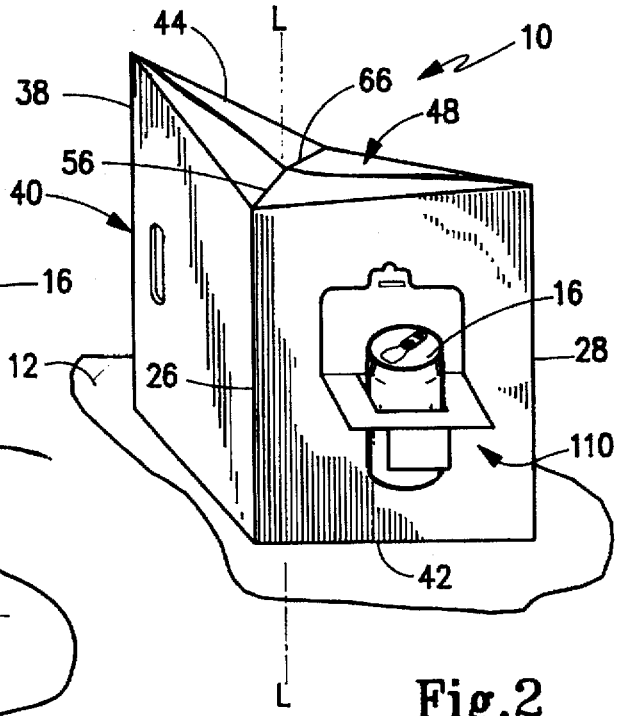
FIG. 2 is a perspective view of the first exemplary embodiment of the present invention shown with the holder receiving a beverage container.

It is also desirable to provide a holder associated with collapsible stool 10 since a person who is resting thereon may desire to enjoy a beverage. Accordingly, holder 110 is provided to receive and support an object, especially a beverage container, when in an open position as shown in FIG. 2. In this Figure, holder 110 is supporting beverage can 16. Holder 110 is disposed on one of the first and second side panels and, in FIGS. 2–8, holder 110 is disposed on front first panel section 22 of first side panel 20. Holder 110 may be folded into a closed position wherein it is stored alongside the selected side panel, such as front first panel section 22, as is shown in FIG. 8.

Preferably, holder 110 is formed by a cutout portion of the selected one of the first and second side panels 20, 30. Holder 110 preferably includes a U-shaped flange 112 defined by a pair of spaced apart legs 114 that are pivotally joined to the selected first or second side panel with legs 114 being joined together by an outer connecting band 116. A support arm 118 is hinged at line 119 to front first side panel section 22 and at line 121 to connecting band 116. When opened into the open position, shown in FIG. 3, support arm 118 folds about a medial hinge line 120 while legs 114 fold about hinge lines 115; thus, support arm 118 defines a cantilever support for flange 112. With reference to FIG. 8, it may be seen that, when in the closed position, hinge lines 115 and 120 are co-linear. Here, also, it may be seen that holder 110 is formed by a pair of slots 122 cut longitudinally through front first panel section 22 and by an inverted U-shaped cutout line 124 extending from the outer ends of hinge lines 115 to span across a region above slots 122. Thus, the area of front first panel section 22 between each of slots 122 and cutout line 124 form legs 114 while the region between legs 114 above slots 122 form connecting band 116. A finger cutout 126 is provided as an open area to allow access to tab 128 so that tab 128 may be manipulated to withdraw holder 110 from the closed position wherein it is stored with respect to side panel 20.

It is desirable to maintain the integrity, that is, the structural strength, of first side panel 20 even where holder 110 is provided. Since the cutout portion forming holder 110 would ordinarily decrease this structural integrity, it is preferred to provide a backing panel for holder 110 with this backing panel being interiorly disposed of and adhered to first front panel section 122 so that it spans this cutout portion. Thus, as is shown in FIGS. 4 and 7, a backing panel 130 is hingedly joined along front hinge line 28 to front second panel section 32 with front first side panel section 22 being adhered to backing panel 130 in any convenient manner, such as a glue adhesive. Therefore, it should be understood that, by reason of the joinder of front first side panel section 22 and backing panel 130 front first side panel section 22 becomes hingedly secured to front second side panel section 32 along the first hinge line 26. That is, front first side panel section 22 is not directly secured to second front side section panel 32 at hinge line 28 other than by virtue of its attachment to backing panel 130. Backing panel 130 is provided with a small slot 132 which is sized and adapted to receive tab 128, if desired, in order to further secure holder 110 in the closed and stored position.

Moreover, in order to facilitate carrying of stool 10, first and second side panels 20 and 30 are provided with handle openings such as openings 134 and 136 which are respectively cut in the rear first and second panel sections 24 and 34, respectively. When stool 10 is moved into the collapsed state, openings 134 and 136 register with one another to form a carrying handle 140 for stool 10 as is shown in FIG. 8.

With reference now to FIG. 9, it may be seen that stool 10 is formed of an integral piece 150 of corrugated material which is cut according to the pattern shown in this Figure. In this Figure, like numerals refer to the same parts discussed above, and it should be appreciated that the hinge lines are formed by score lines which crease the corrugated material so that it may fold readily about the hinge lines. In construction, backing panel 130 is folded along front hinge line 28 so that it confronts front second panel section 32. An adhesive, such as glue bands 152 and 154 is applied to front first side panel section 22, and first side panel 20 is folded with respect to second side panel 30 along rear hinge line 38 so that front first side panel section 22 will become adhered to backing panel 30 by glue bands 152 and 154. Thus, the construction of stool 10 is very simple.

Figure 3:
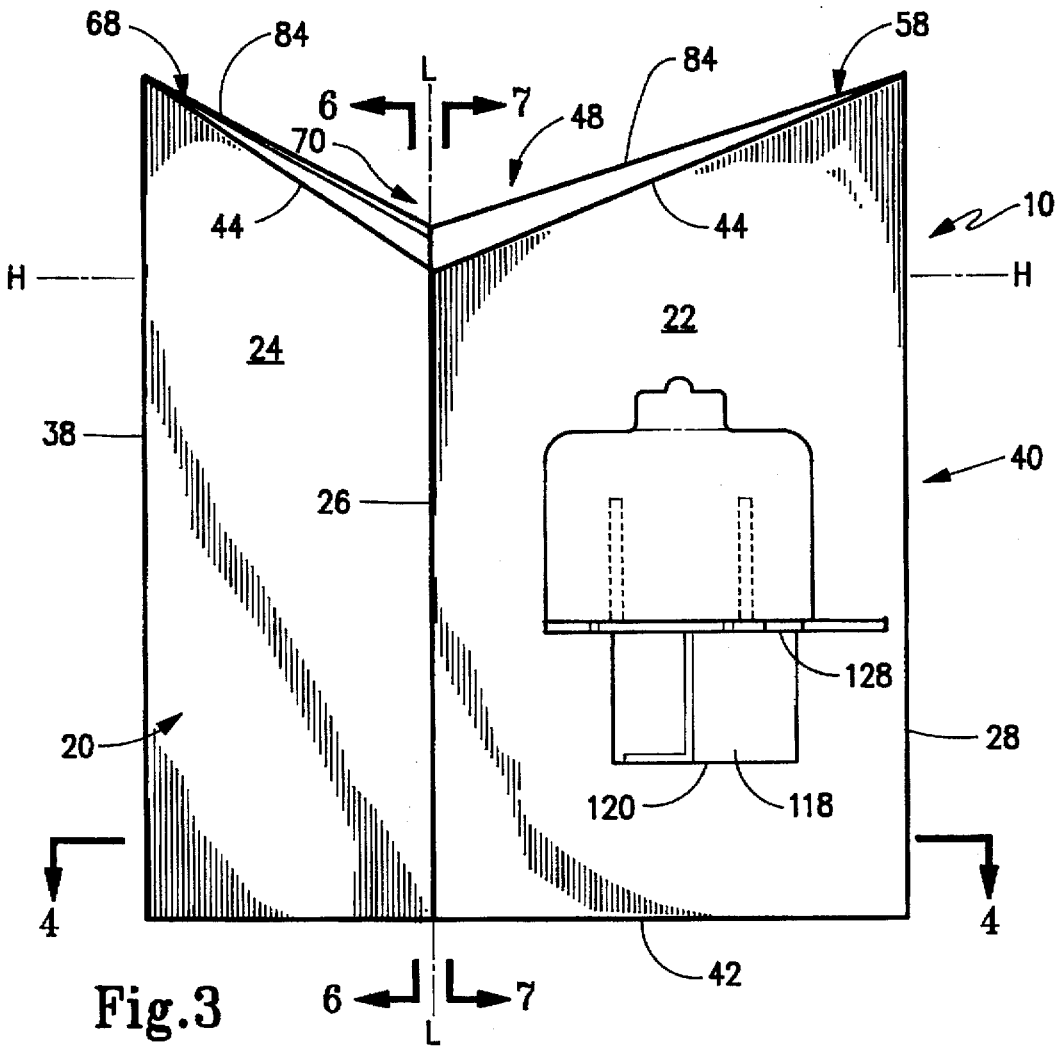
FIG. 3 is a side view in elevation of the first exemplary embodiment of the present invention in the erected state.

Moreover, with reference again specifically to FIG. 9, but also with reference to FIGS. 2–8, it may be seen that each of the first and second front side panel sections 22, 32 have a common front panel section width. Likewise, the rear first and second side panel sections have a common rear panel width. However, the front side panel width is greater than the rear panel width so that the angle of the forward portion of seat 48 is smaller than the angle of the rearward portion of seat 48 with reference to horizontal plane "H". These angles are preferably at least 20° and 40°, respectively to horizontal plane "H", as shown in FIG. 3. This construction for the saddle seat 48 is ergonomically contoured to the shape of the human body. Furthermore, due to the inclination of seat panels 52, 54, 62 and 64, when a person sits on stool 10, additional support is provided so that the weight of the person tends to expand the first and second side panels apart from one another against the tension created in these side panels. This increases the stability of stool 10.

Figure 10:
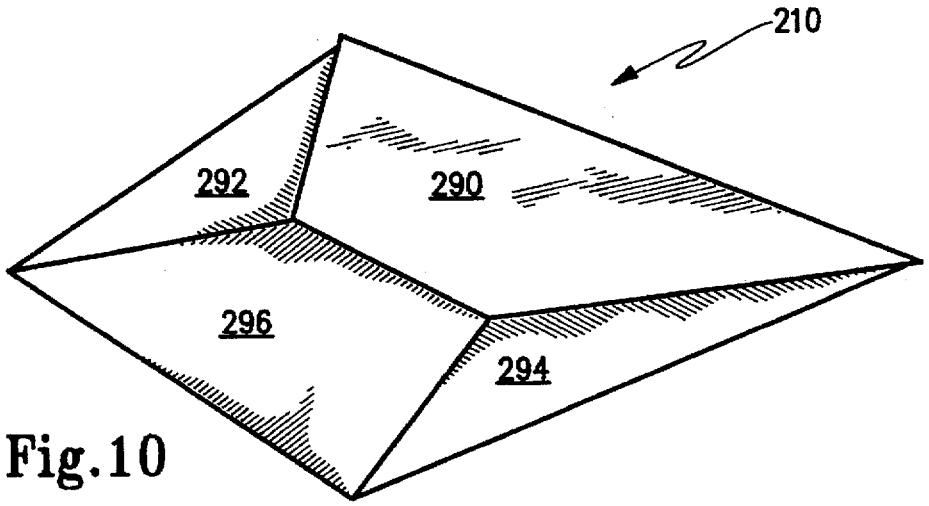
FIG. 10 is a bottom plan view of a second exemplary embodiment of the present invention.
Figure 11:
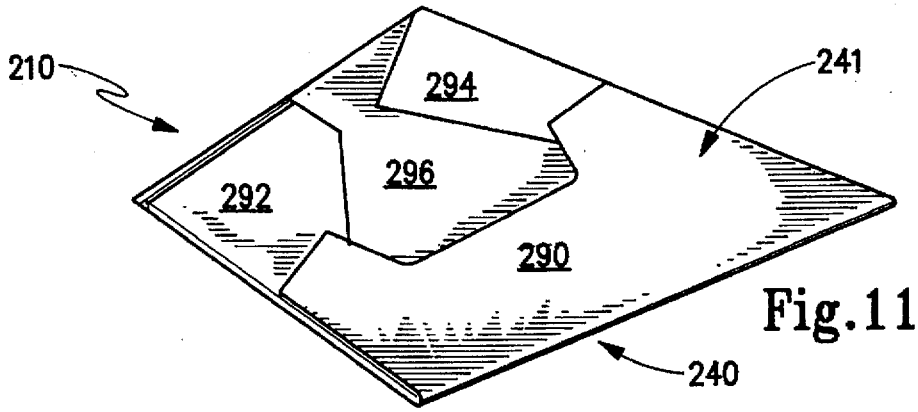
FIG. 11 is a cross-sectional view, similar to FIG. 4, showing the bottom closure of the second exemplary embodiment of the present invention.
Figure 12:
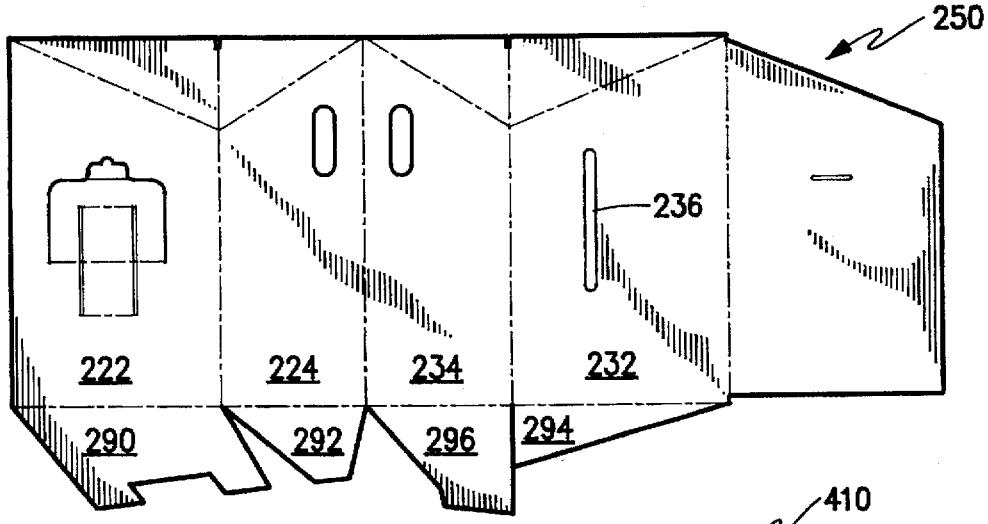
FIG. 12 is a side view in elevation of a piece of corrugated material used to form the portable collapsible stool according to the second exemplary embodiment of the present invention.

With reference to FIGS. 10–12, a second exemplary embodiment of the present invention is shown. Here, stool 210 is constructed substantially identically to stool 10 except for the lower flaps which are adapted to confront the support surface. As is shown in these Figures, flap 290 is formed as an integral extension of front first side panel section 222 while flap 292 is formed as an integral extension of rear first side panel section 224. Likewise, flap 294 is formed as an integral extension of front second side panel section 232 while flap 296 is formed as an integral extension of rear second side panel section 234. With reference to FIGS. 10 and 11, it may be seen that flaps 290, 292, 296 and 294 are sized and configured so as to extend sufficiently across support post 240 to releaseably interlock with one another thereby to enclose base end 241 of stool 210. This structure has the advantage of forming a carrying carton when stool 210 is in the erected state with the seat forming panels being opened. Thus, a user may place objects inside of stool 210 for transport. However, when the stool is to be erected, the user may simply set the stool down and fold the seat into the interlocked state with the objects enclosed and protected by the stool 210. Alternatively, of course, the user may remove the objects before completing the erection of stool 210. Finally, with reference again to FIG. 12, it may be seen that integral piece 250 of corrugated material used to form stool 210 is constructed identically as piece 150 with the exception of the configuration of the bottom flaps 290, 292, 294 and 296. With reference to this Figure, also, longitudinal slot 236 may be provided. Slot 236 permits a user to insert sheet-like materials directly into the interior of the stool 210 when the stool is used as a carrying carton. The stool may then be mailed, if desired, by a commercial carrier or other postal service.

Figure 13:
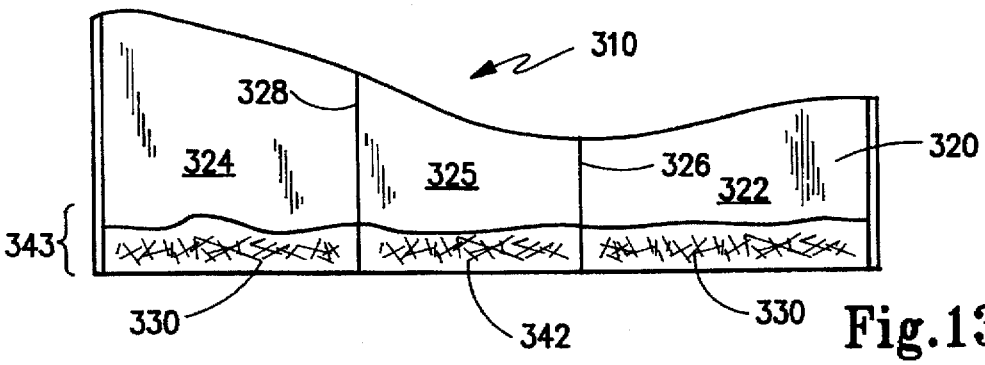
FIG. 13 is a side view in cross-section showing the bottom portion of a third exemplary embodiment of the present invention.

A third exemplary embodiment of the present invention is shown in FIG. 13. Here, a side cross-section view of stool 310 is provided to show that a representative side panel, such as side panel 320, may be constructed by more than two side panel sections, as was the case in the first two exemplary embodiments. Thus, for example, side panel 320 of stool 310 includes a front first side panel section 322, a rear first side panel section 324 which are interconnected by a medial side panel section 325. Medial side panel section 325 is hingedly secured to front side panel section 322 along hinge line 326 while medial panel 325 is hingedly secured to rear side panel section 324 along hinge line 328. Other configurations of these multiple side panel sections are certainly within the scope of this invention, as would be constructed by the ordinarily skilled person having read the disclosure herein.

Figure 14:
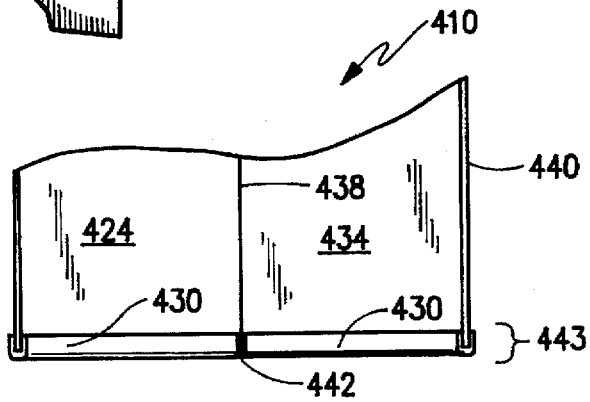
FIG. 14 is an end view in cross-section showing a lower portion of a fourth exemplary embodiment of the present invention.

The embodiment shown in FIG. 13 also provides an alternative to the protection of the corrugated material from the intrusion of moisture. Here, instead of providing bottom flaps, a coating 330 of water resistant material is provided along a base edge margin 343 proximate to base edge 342. Here, coating 330 can be wax, plastic, paint, ultraviolet coating, aqueous coating, etc., as is known in the art to protect the material out of which stool 310 is fabricated. Finally, with respect to FIG. 14, a still further alternative embodiment for protecting the bottom edge of the columnar support post is provided. In FIG. 14, stool 410 has a base edge 442 for columnar support post 440 for which the rear first side panel section 424 and the rear second side panel section 434 are shown hingedly secured to one another at rear hinge line 438. Here, however, protection of bottom edge 442 is provided by means of plastic channel pieces 430 which are frictionally clipped onto the base edge margin 443 adjacent to base edge 442.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

We claim:

1. A collapsible stool adapted to support a user in a seated position above a support surface when in an erected state and foldable into a collapsed state for transport and storage, comprising:

(a) first and second side panels that confront one another when said stool is in the collapsed state yet which are expanded away from one another and away from a longitudinal axis when said stool is in the erected state thereby to create a support post extending in a longitudinal direction about the longitudinal axis, said support post when in the erected state having an interior and having a base edge adapted to engage the support surface, a top edge opposite said base edge, and a surrounding sidewall formed by said first and second side panels; and (b) first and second seat panels which are hingedly disposed on said first and second side panels, respectively, said first and second seat panels movable into an orientation wherein they extend inwardly toward one another from said top edge to terminate respectively in first and second edge margins, said first and second edge margins interlocking with one another when said stool is in the erected state to form a seat upon which a user may sit in the seated position, said seat being configured in a saddle-shape having elevated forward and rearward corner portions relative to a middle portion thereof.

2. A collapsible stool according to claim 1 wherein said first and second side panels are hingedly connected to one another along a longitudinally extending front hinge line and along a longitudinally extending rear hinge line, said first side panel being constructed of a plurality of first side panel sections with adjacent ones of said first side panel sections being hingedly connected to one another along a longitudinally extending first side hinge line, said second side panel being constructed of a plurality of second side panel sections with adjacent ones of said second side panel sections being hingedly connected to one another along a longitudinally extending second side hinge line.

3. A collapsible stool according to claim 2 wherein said first seat panel is constructed of a plurality of first seat panel sections with adjacent ones of said first seat panel sections being hingedly connected to one another along first seat hinge lines and wherein said second seat panel is constructed of a plurality of second seat panel sections with adjacent ones of said second seat panel sections being hingedly connected to one another along second seat hinge lines.

4. A collapsible stool according to claim 3 wherein said first seat panel is formed as a longitudinal extension of said first side panel and said second seat panel is formed as a longitudinal extension of said second side panel, each of said first seat hinge lines formed as an extension of a respective first side hinge line and each of said second seat hinge lines formed as an extension of a respective second side hinge line.

5. A collapsible stool according to claim 4 wherein said first and second side panels and said first and second seat panels are constructed of corrugated material with said front hinge line, said rear hinge line, said first and second side hinge lines and said first and second seat hinge lines being formed as creased score lines in said corrugated material.

6. A collapsible stool according to claim 5 wherein said corrugations in said first and second side panels extend longitudinally.

7. A collapsible stool according to claim 5 wherein said first and second side panels and said first and second seat panels are constructed as an integral piece of corrugated fiberboard.

8. A collapsible stool according to claim 5 including first and second bottom flaps respectively formed as an integral extension of said first and second side panels and disposed along the base edge of said support post, said first and second bottom panels foldable into a transverse orientation with respect to the longitudinal axis.

9. A collapsible stool according to claim 8 wherein said first and second bottom flaps releasably interlock one another thereby enclosing a base end of said support post.

10. A collapsible stool according to claim 1 including a holder disposed on one of said first and second side panels, said holder movable between an open position wherein said holder projects outwardly from said one of said first and second side panels such that said holder is operative to receive and support an object and a closed position wherein said holder is stored alongside said one of said first and second side panels.

11. A collapsible stool according to claim 1 wherein said first and second seat panels being sized and configured, when interlocked, such that each is inclined upwardly to form a central peak.

12. A collapsible stool according to claim 11 wherein one of said first and second side panels includes an insertion slot operative to permit insertion of sheet-like materials therethrough from an exterior to the interior of the support post.

13. A collapsible stool according to claim 1 wherein said support post is formed as a hollow column when the stool is in the erect state.

14. A collapsible stool adapted to support a user in a seated position above a support surface when in an erected state and foldable into a collapsed state for transport and storage, comprising:

(a) a first side panel constructed of a corrugated material, said first side panel including front and rear first panel sections that are joined at a longitudinally extending first hinge line;

(b) a second side panel constructed of said corrugated material, said second side panel including front and rear second panel sections that are joined at a longitudinally extending second hinge line, said first and second side panels being joined to one another along longitudinally extending front and rear hinge lines and formed so that said first and second side panels confront one another when said stool is in the collapsed state yet which are expanded away from one another and away from a longitudinal axis when said stool is in the erected state thereby to create a support post extending in a longitudinal direction about the longitudinal axis, said support post when in the erected state having an interior and having a base edge defined by lower edges of said first and second side panels with said base edge adapted to engage the support surface, a top edge opposite said base edge and defined by upper edges of said first and second side panels, and a surrounding sidewall formed by said first and second side panels;

(c) a first seat panel which is formed by front and rear first seat panel sections hingedly secured respectively to said front and rear first side panel sections along an upper edge of said first side panel and to each other along a first seat hinge line, said first seat panel terminating in a first seat edge margin opposite the upper edge of the first side panel; and (d) a second seat panel which is formed by front and rear second seat panel sections hingedly secured respectively to said front and rear second side panel sections along an upper edge of said second side panel and to each other along a second seat hinge line, said second seat panel terminating in a second seat edge margin opposite the upper edge of the second side panel, said first and second seat panels movable into an orientation wherein they extend inwardly toward one another from said top edge when said stool is in the erected state such that said first and second seat edge margins interlock with one another to form a seat on which a user may sit.

15. A collapsible stool according to claim 14 wherein the seat formed by said first and second seat panels is configured in a saddle-shape having elevated forward and rearward end portions relative to a middle portion thereof.

16. A collapsible stool according to claim 14 including a holder disposed on one of said first and second side panels, said holder movable between a open position wherein said holder projects outwardly from said one of said first and second side panels such that said holder is operative to receive and support an object and a closed position wherein said holder is stored alongside said one of said first and second side panels.

17. A collapsible stool according to claim 16 wherein said holder is formed by a cut-out portion of said one of said first and second side panels.

18. A collapsible stool according to claim 17 wherein said holder includes a U-shape flange defined by a pair of spaced apart legs pivotally joined to said one of said first and second side panels and an outer connecting band interconnecting said legs and a support arm pivotally joined to said one of said first and second side panels and to said outer connecting band.

19. A collapsible stool according to claim 17 including a backing panel disposed interiorly of said support post alongside said one of said first and second side panels and dimensioned to span the cut-out portion thereof.

20. A collapsible stool according to claim 19 wherein said backing panel is provided with a slot, said holder including a tab sized and adapted to be inserted into the slot thereby to retain said holder in the stored state.

21. A collapsible stool according to claim 19 wherein said first side panel, said second side panel, said first seat panel, said second seat panel and said backing panel are formed as an integral piece of corrugated material.

22. A collapsible stool according to claim 14 wherein said first and second side panels have a plurality of longitudinally oriented corrugations.

23. A collapsible stool according to claim 22 including a water-resistant coating disposed on said first and second side panels along lower edge margins thereof.

24. A collapsible stool according to claim 22 including first and second bottom flaps each respectively formed as an integral extension of said first and second side panels and disposed along the lower edges thereof, said first and second bottom panels foldable into a transverse orientation with respect to the longitudinal axis.

25. A collapsible stool according to claim 24 wherein said first and second bottom flaps releasably interlock one another thereby enclosing a base end of said support post.

26. A collapsible stool according to claim 25 wherein one of said first and second side panels includes an insertion slot operative to permit insertion of sheet-like materials therethrough from an exterior to the interior of the support post.

27. A collapsible stool according to claim 26 wherein the insertion slot is oriented longitudinally.

28. A collapsible stool according to claim 14 wherein said front first panel section and said front second panel section have a common front panel section width and said rear first panel section and said rear second panel section have a common rear panel width, said front panel width being greater than said rear panel width.

29. A collapsible stool according to claim 14 wherein said first and second side panels each have a handle opening formed therein, which handle openings register with one another when in the collapsed state thereby to form a carrying handle for said stool.

* * * * *